US007018133B2

(12) United States Patent
Peterson

(10) Patent No.: US 7,018,133 B2
(45) Date of Patent: Mar. 28, 2006

(54) CONCRETE FINISHING SCREED

(75) Inventor: Erik C. Peterson, Milwaukee, WI (US)

(73) Assignee: Metal Forms Corp., Milwaukee, WI (US)

( * ) Notice: Subject to any disclaimer, the term of this patent is extended or adjusted under 35 U.S.C. 154(b) by 19 days.

(21) Appl. No.: 10/831,612

(22) Filed: Apr. 23, 2004

(65) Prior Publication Data

US 2005/0238430 A1 Oct. 27, 2005

(51) Int. Cl.
*E01C 19/22* (2006.01)

(52) U.S. Cl. ..... 404/118; 404/75; 404/101

(58) Field of Classification Search ..... 404/101, 404/118, 75

See application file for complete search history.

(56) References Cited

U.S. PATENT DOCUMENTS 4,340,351 A * 7/1982 Owens ..... 425/456
4,349,295 A * 9/1982 Morrison ..... 404/114
4,427,358 A * 1/1984 Stilwell ..... 425/432
4,685,826 A * 8/1987 Allen ..... 404/114
4,950,101 A * 8/1990 Artzberger ..... 404/114
5,871,302 A * 2/1999 Carlson ..... 404/96
6,457,902 B1 10/2002 Artzberger et al.

* cited by examiner

*Primary Examiner*—Raymond W Addie
(74) *Attorney, Agent, or Firm*—Sonnenschein Nath & Rosenthal, LLP

(57) ABSTRACT

A cement finishing screed is provided which comprises a frame member extending a length of the screed. The frame member includes a first lower beam member, a second lower beam member, an upper beam member, and a plurality of truss members securing the first and second lower beam members and the upper beam member together in a fixed relationship. Each truss member has two arcuate rod portions extending from the first lower beam member and the second lower beam member, respectively, to the upper beam member, and a strut portion extending from a lower end of one of the rod portions to a lower end of another of the rod portions.

29 Claims, 5 Drawing Sheets

CONCRETE FINISHING SCREED

BACKGROUND OF THE INVENTION

Truss screeds are widely used to level and preliminarily finish freshly poured concrete. A typical truss screed includes at least one screed plate and a triangular truss frame that supports the screed plate and other components of the machine. The ends of the screed plate are configured to be supported on an upper edge of a form surrounding a slab of freshly-poured concrete. In use, the screed is pulled along the form, either by a manually operated or power operated winch, so that the screed plate pushes the formed concrete ahead of it to level the concrete. Oftentimes, the screed is sectional. That is, it consists of modular sections that are connected to one another in an end-to-end fashion. Sections can be added or removed as desired to change the effective length of the screed, thus permitting the screed to be used on concrete slabs of variable widths. The relative angular orientation of the various sections can also be adjusted to alter the profile of the leveled concrete, e.g., to impart a crown or a slant to the leveled surface.

Vibrational forces can be imparted to the screed plate during a concrete leveling operation. Vibration during screeding helps settle and densify the concrete. Vibrational screeding also removes air voids from the concrete and brings excess water and fine layers of concrete aggregated to the surface, hence partially finishing the leveled concrete. Vibrational forces are typically imparted using an exciter shaft that is located near the screed plate and that is driven to rotate via a motor such as an internal combustion engine. The exciter shaft supports eccentric weights that generate vibrations upon exciter shaft rotation. The vibrations are transmitted to the screed plate through the exciter shaft and its bearings.

The triangular truss frame is typically formed of several beams extending the length of the screed, or extending the length of each module and are connected end-to-end to form a longer effective length of the screed. The beams are generally arranged in a triangle when viewed from an end of the truss frame, with an upper beam at an apex of the triangle and a first and second lower beam forming the lower two corners of the triangle. A series of struts are arranged, generally horizontally, to hold the two lower beams in a fixed, parallel relationship, and a series of struts extend between each lower beam and the upper beam to hold the upper beam in a fixed parallel relationship relative to the lower beams. Such an arrangement is shown in U.S. Pat. No. 6,457,902.

Vibrating truss screeds used for concrete construction have traditionally consisted of either 1) a welded steel or aluminum frame, or 2) a bolt-together assembly of beams, rods and struts. A third design utilizes cast truss sections that are attached to the beams with fasteners. Problems arise with welded truss sections because of the heat-affected zones. The vibration exerted by the machine leads to shear failure at a certain number of cycles. Castings attempted to solve the problem, but inadvertently caused a cost increase.

It would be an advance in the art if a truss frame were provided that is light weight, cost effective, sturdy and stiff, which allows for ease of use and modification as the size of various jobs requiring the screed changes.

SUMMARY OF THE INVENTION

The present invention provides a truss frame that has a reduced weight, yet has added strength and stiffness in comparison to prior truss frame designs. The inventive truss frame is easily assembled and sections can be coupled together quickly and effectively.

In an embodiment, a concrete finishing screed is provided which comprises a frame member extending a length of the screed, the frame member including a first lower beam member, a second lower beam member, an upper beam member, and a plurality of truss members securing the first and second lower beam members and the upper beam member together in a fixed relationship. The truss members may be formed in different configurations within the scope of the present invention. In one embodiment, each truss member has two arcuate rod portions extending from the first lower beam member and the second lower beam member, respectively, to the upper beam member, and a strut portion extending from the first lower beam member to the second lower beam member.

In an embodiment of the invention, each truss member has four arcuate rod portions, two of the rod portions extending from the first lower beam member at a first end to the upper beam member at a second end and two of the rod portions extending from the second lower beam member at a first end to the upper beam member at a second end, two strut portions, each extending from a first end of one rod portion at one of the lower beam members to a first end of another rod portion at one of the lower beam members.

In an embodiment of the invention, the truss members each comprise a single piece metal stamping comprising a first arcuate portion having a first end arranged to extend from the first lower beam and a second end arranged to extend from the second lower beam, a first strut portion arranged to extend from said first end to said second end, a second arcuate portion having a first end arranged to extend from said first lower beam and a second end arranged to extend from said second lower beam, a second strut portion arranged to extend from the first end to the second end of the second arcuate portion, and a connecting portion joining the first arcuate portion to the second arcuate portion midway between the first and second ends.

In an embodiment of the invention, the truss members each comprise a stamped sheet metal member having a first D shaped portion formed by a substantially linear portion connected to an arcuate shaped portion and a second D shaped portion also formed by a substantially linear portion connected to an arcuate shaped portion, the two arcuate shaped portions joined together near their apexes by a connecting portion.

In an embodiment of the invention, the truss members each comprise a stamped sheet metal member having a first D shaped portion formed by a substantially linear portion connected at a first and second junction to an arcuate shaped portion, the arcuate shaped portion being attached to the upper beam member near its apex and the arcuate shaped portion being attached to the lower beam members near each junction of the arcuate portion and the substantially linear portion.

In an embodiment of the invention, the truss members each comprise a single piece metal stamping comprising an arcuate portion having a first end arranged to attach to the first lower beam, a second end arranged to attach to the second lower beam and a midpoint arranged to attach to the upper beam, and a strut portion arranged to extend from the first end to the second end of the arcuate portion.

In an embodiment of the invention, the truss members each comprise a single piece metal stamping comprising an arcuate portion having a first end arranged to attach to the first lower beam, a second end arranged to attach to the second lower beam and a midpoint arranged to attach to the upper beam, the truss members further comprise a strut portion arranged to extend between the first lower beam member and the second lower beam member.

DETAILED DESCRIPTION OF THE PREFERRED EMBODIMENTS

Figure 1:
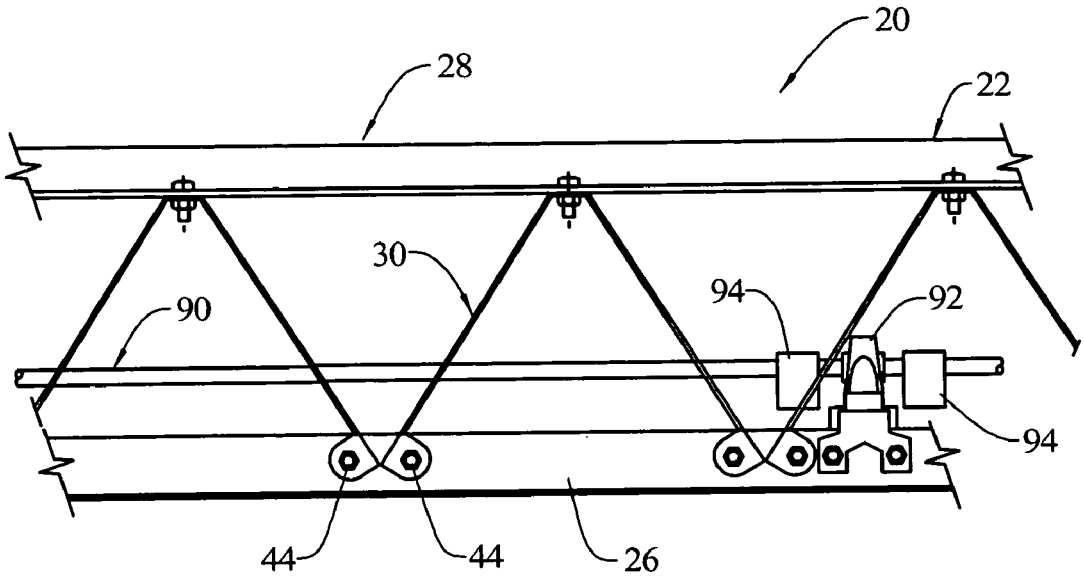
FIG. 1 is a partial side sectional view taken generally along the line I—I of FIG. 2, showing a concrete screed embodying the principles of the present invention.
Figure 2:
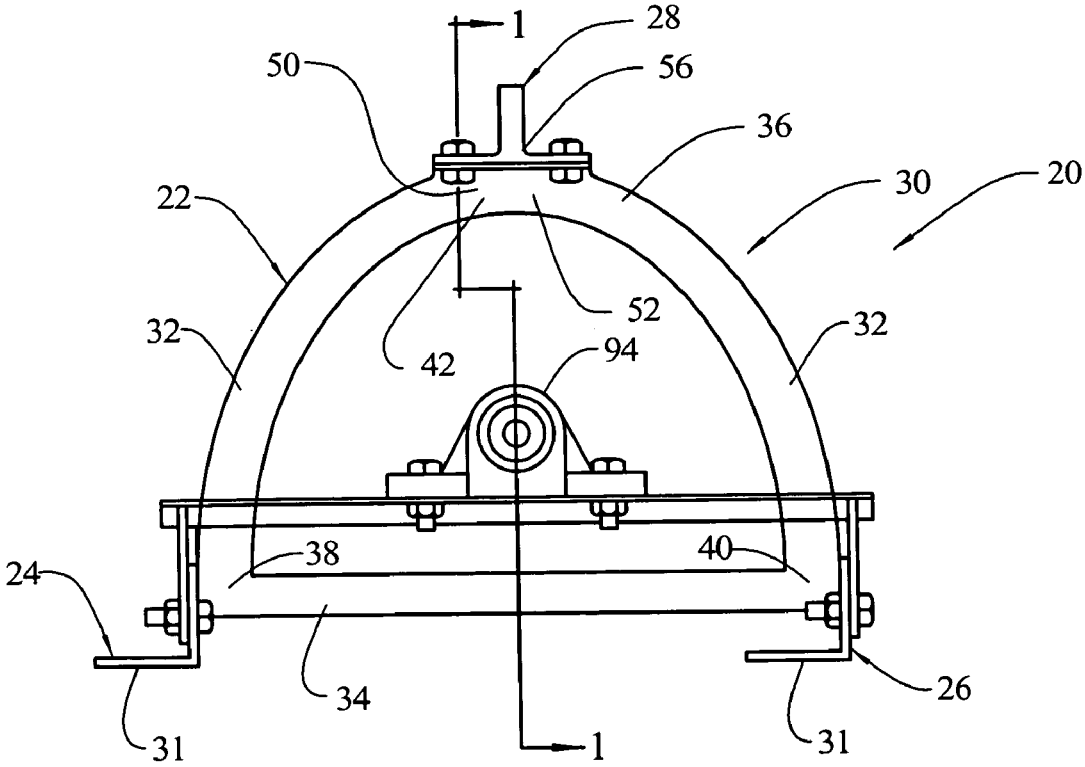
FIG. 2 is an end elevational view of the concrete screed of FIG. 1.

FIGS. 1 and 2 illustrate an embodiment of a concrete finishing screed 20 utilizing the principles of the present invention. The screed 20 includes a frame member 22 which extends a length of the screed. The frame member 22 includes a first lower beam member 24, a second lower beam member 26, an upper beam member 28, and a plurality of truss members 30 securing the first and second lower beam members and the upper beam member together in a fixed triangular relationship as seen in FIG. 2. The lower beam members 24, 26 have planar bottom surfaces 31 which are arranged parallel to each other and lie substantially in the same plane. These surfaces 31 engage the curing concrete. The lower beam members 24, 26 can have several cross sectional configurations, such as L-shaped as shown, or square, rectangular, triangular, U-shaped or inverted T-shaped. The upper beam 28 is illustrated as having an inverted T-shape, but it also could have a wide variety of cross sectional configurations as previously mentioned.

The truss members can also be formed in a variety of configurations and shapes. In some embodiments described below, the truss member is formed as a single integral member having two virtually identical sides with a connecting portion (FIGS. 1–5), the truss member could be formed as a single integral member with a single side (FIGS. 7–9), and adjacent sides assembled together, and the truss member could be formed from multiple pieces all assembled together to form the truss member (FIG. 10).

In the embodiments shown in the Figures, each truss member 30 has two arcuate rod portions 32 extending from the first lower beam member 24 and the second lower beam member 26, respectively, to the upper beam member 28, and a strut portion 34 extending between the lower end of two rod portions.

In the embodiments illustrated in FIGS. 2, 3–5, 7–9, the two rod portions 32 of each truss member 30 are integrally formed as a single continuous arcuate member 36 attached at a first end 38 to the first lower beam member 24, attached at a second end 40 to the second lower beam member 26 and attached at a midpoint 42 to the upper beam member 28. Although the arcuate member 36 can have a variety of shapes, in an embodiment, it has a parabolic shape. A parabolic shape provides additional strength; strength not provided by a traditional welded-steel frame.

Figure 10:
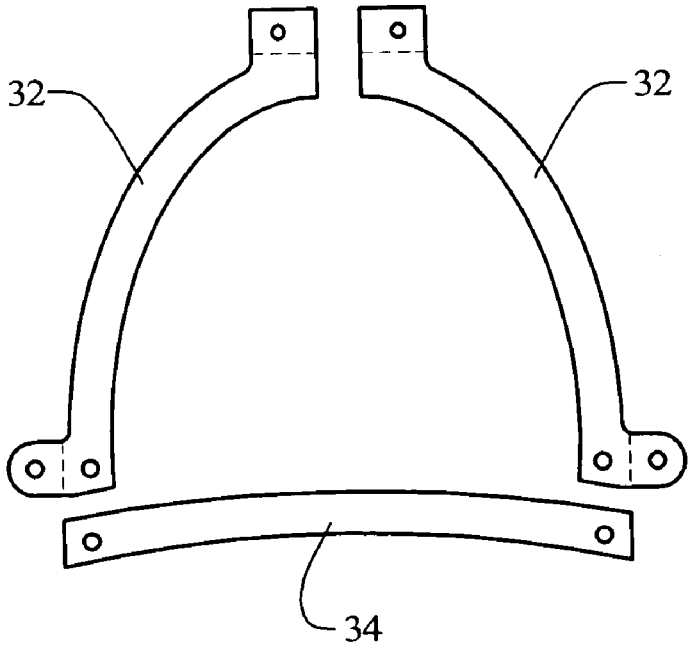
FIG. 10 is an exploded view of a multi-piece truss member as an alternate embodiment of the present invention.

As shown in the embodiment illustrated in FIG. 10, the two rod portions 32 of each truss member 30 are separately formed rather than being integrally formed as previously described. The two separate rod portions 32 could be joined together before or during assembly with the beam members 24, 26, 28.

In some embodiments of the invention, as shown in FIGS. 2–5, 7–9 the strut portion 34 of each truss member 30 is integrally formed with the continuous arcuate member 36 as a single and unitary truss member, the strut portion 34 connecting the first end 38 and the second end 40 of the continuous arcuate member 36.

In the embodiment shown in FIG. 10, the strut portion 34 is formed separately from the rod portions 32. The strut portion 34 could be joined with the rod portions 32 before or during assembly with the beam members 24, 26, 28.

In other embodiments, the rod portions 32 could be formed as an integral member with the strut portion 34 formed separately, or the strut portion could be formed integrally with one rod member, and the second rod member formed separately.

Figure 3:
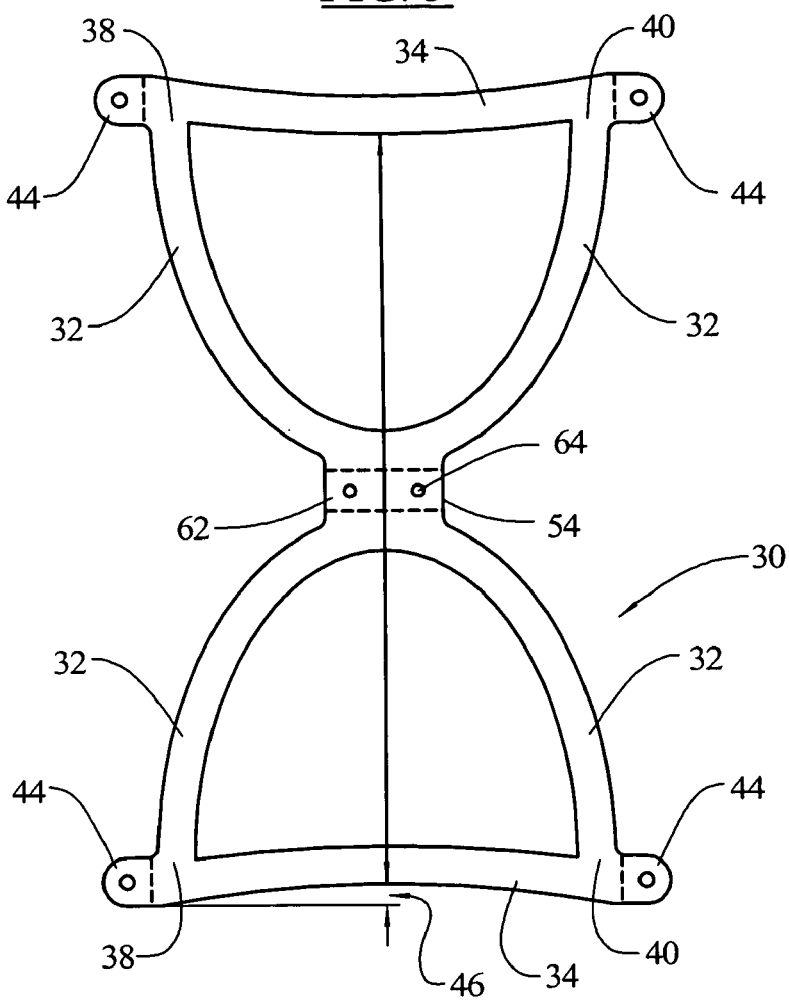
FIG. 3 is a plan view of an embodiment of a double sided truss member, prior to being bent into shape.
Figure 4:
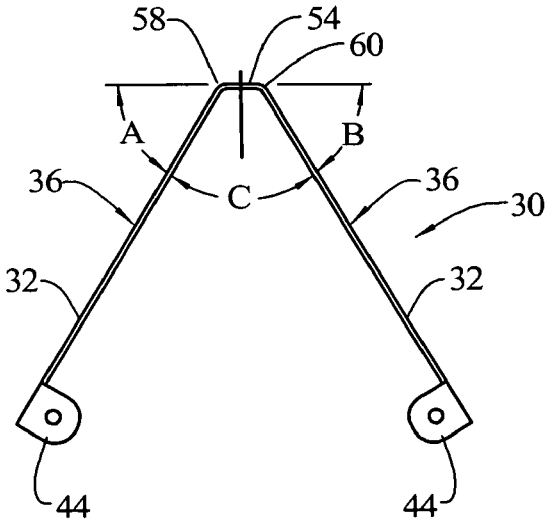
FIG. 4 is a side elevational view of the truss member of FIG. 3, after being folded.
Figure 5:
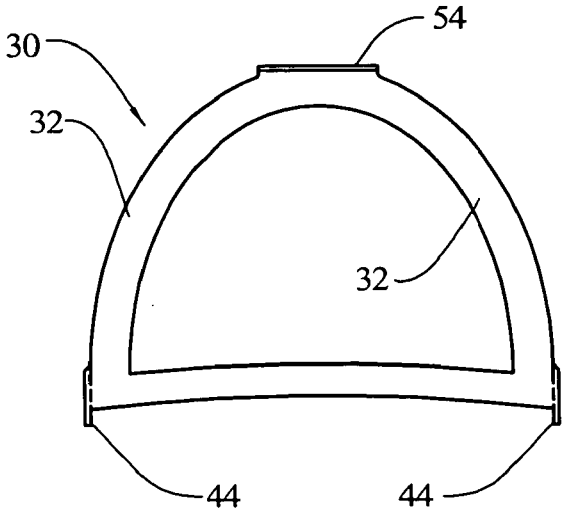
FIG. 5 is a front elevational view of the truss member of FIG. 4.

As an example of an attachment arrangement, each of the arcuate rod portions 32 attaches to the lower beam portion 24, 26 by means of an extending tab 44. As shown in FIGS. 4 and 5, the tabs 44 each lie in a plane approximately perpendicular to a plane in which its associated arcuate rod portion 32 lies. As best seen in FIG. 3, the tabs comprise an extension of the strut portion 34 and extend outwardly of the arcuate rod member 32 substantially in line with the strut portion, and bent at a right angle to the rod member.

In some embodiments, such as shown in FIG. 3, the strut portion 34 has a slight arcuate shape. Generally the deviation, as measured as a displacement 46 midway along the length of the strut portion 34, is less than 10% of a length of the strut portion from the first end 38 to the second end 40. In such an arrangement, if the length of the strut were 10 inches, the deviation 46 would be less than 1 inch.

Although the truss members could be attached to the beam members 24, 26 and 28 by several different methods, including welding and mechanical fasteners, mechanical fasteners provide a mechanical advantage in that they avoid heat-affected zones which would be susceptible to damage due to vibration exerted by the machine. The use of mechanical fasteners, including rivets or threaded fasteners through holes provided in the truss members 30 and the beam members 24, 26 and 28, eliminates any chance of failure due to heat affected zones.

In an embodiment, each truss member 30 is attached to the upper beam 28 and the first 24 and second 26 lower beam members by means of threaded fasteners 48. While many different types of threaded fasteners could be used, applicants have found that serrated-head flanged cap screws and nuts are preferred in that they resist loosening, caused by vibration, through use of the serrated head. The serration cuts into the mating surface, embedding itself, creating a "lock" that requires more torque to remove than to install. This "lock" eliminates the need to use any type of thread-locking compound or locking washer. The fastener's flanged head eliminates the need to use flat washers to cover oversized holes, while increasing load distribution. The serrated head flanged nuts do not require a mechanical deformation or nylon insert to perform the "lock," therefore they thread onto the cap screws as easily and quickly as standard, non-locking hex nuts.

In an embodiment of the invention, the truss member 30 may be formed as a single integral member having two virtually identical sides with a connecting portion. Each side would include an arcuate portion 36 and a strut portion 34. In such an embodiment, as shown in FIGS. 3–5, each truss member 30 has four arcuate rod portions 32, two of the rod portions to extend from the first lower beam member 24 at the first end 38 to the upper beam member 28 at a second end 50 and two of the rod portions 32 to extend from the second lower beam member 26 at the rod'slower end 40 to the upper beam member 28 at a second end 52. Two strut portions 34 are integrally formed with the rod portions 32, each extending from the lower end 38, 40 of one rod portion 32 at one of the lower beam members 24, 26 to the lower end 38, 40 of another rod portion 32 at one of the lower beam members 24, 26.

When the truss member 30 is attached to the upper 28 and lower 24, 26 beam members, the connecting portion 54 is arranged in a plane parallel to a lower surface 56 (FIG. 2) of the upper beam member 28. The first arcuate portion 36 lies in a plane angled downwardly from a first side 58 of said connecting portion at an acute angle A relative to the plane of the connecting portion 54 and the second arcuate portion 36 lies in a plane angled downwardly from a second, opposite side 60 of the connecting portion at an acute angle B relative to the plane of the connecting portion. The connecting portion 54 includes an area 62 for attaching to the upper beam member 28. This area 62 may include holes 64 for receiving fasteners.

As described above, the first arcuate portion 36 and the first strut portion 34 have a first extending tab 44 for attaching to the first lower beam member 24 and a second extending tab 44 for attaching to the second lower beam member 26. The first and second tabs 44 each lie in a plane approximately perpendicular to a plane in which the arcuate portion lies.

Figure 6A:
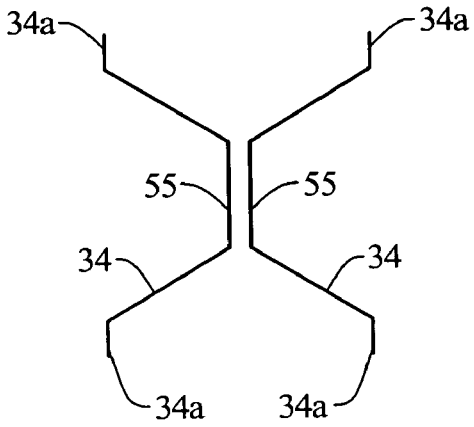
FIG. 6*a* is a schematic plan view of a pair of strut portions in positioned to be abutted.
Figure 6:
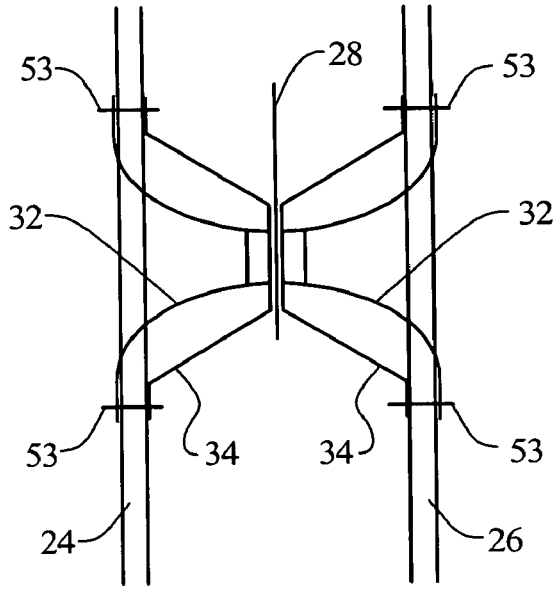
FIG. 6 is a schematic plan view of an assembled truss member with an alternate strut configuration.

In the embodiment illustrated in FIGS. 1–5, the strut portions 34, when assembled to the beam members, extend from a rod portion 32 at the first lower beam member 24 to a rod portion at the second lower beam member 26. However, the strut portions 34 may be configured in alternate ways, such as to extend substantially lengthwise from one rod member 32 to another rod member 32, rather than widthwise. Such an arrangement is schematically shown in FIGS. 6 and 6*a*, which would require that that strut portions 34 be formed separately from the rod portions 34. Via tabs 34*a*, the strut portions 34 in such an arrangement, while still extending from one rod portion 32 to another rod portion, could be attached separately to the interposing lower beam members 24, 26, but could also utilize the same fasteners as used by the rod portions 32 as indicated at 53. To maintain the separation and stability of the two lower beam members 24, 26, two strut portions 34 would abut each other, side to side as shown in FIG. 6. FIG. 6*a* shows the two strut portions 34 in isolation, in position to be abutted together. If desired, the strut portions 34 could be secured to each other at the overlying abutting areas 55.

In an embodiment of the invention, such as illustrated in FIGS. 1–5 and 7–9, the truss members 30 each comprise a stamped sheet metal member having a D shaped portion formed by a substantially linear portion 34 connected at a first 38 and second 40 junction to an arcuate shaped portion 36, the arcuate shaped portion being attached to the upper beam member 28 near its apex 42 and the arcuate shaped portion being attached to the lower beam members 24, 26 near each junction of the arcuate portion and the substantially linear portion.

Figure 7:
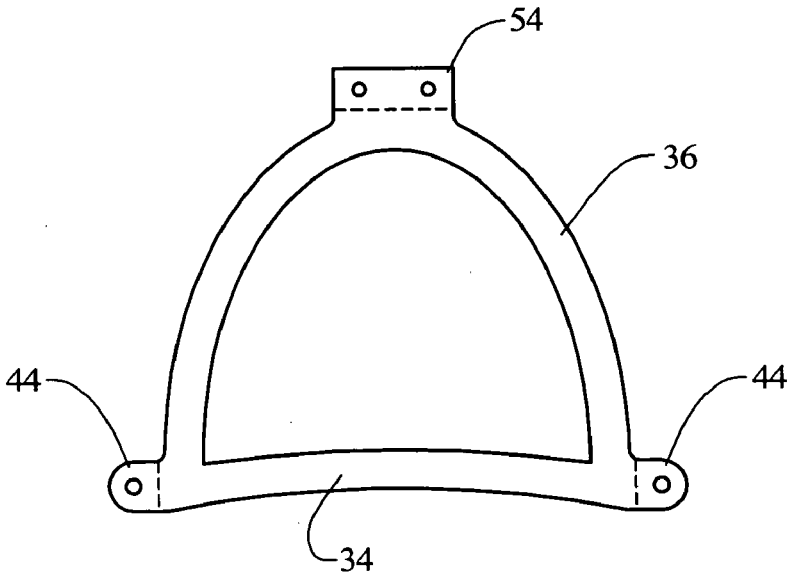
FIG. 7 is a plan view of an embodiment of a single sided truss member, prior to being bent into shape.
Figure 8:
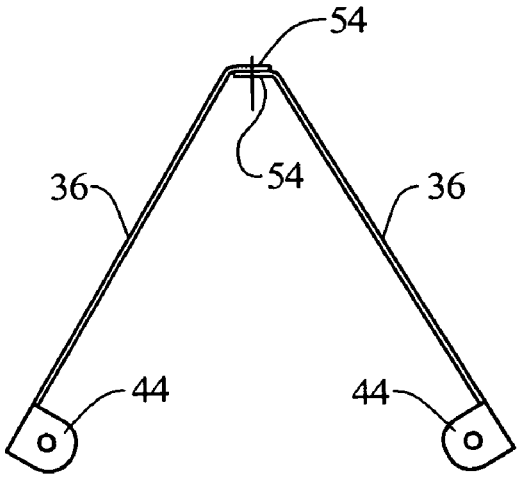
FIG. 8 is a side elevational view of two truss members, as shown in FIG. 7, in an assembled relationship.
Figure 9:
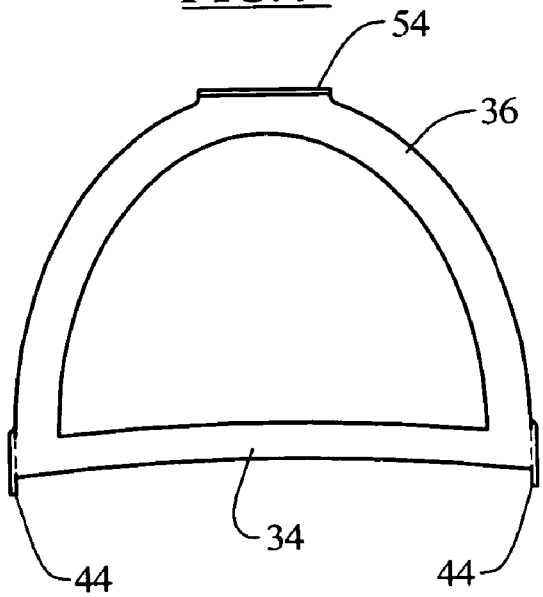
FIG. 9 is a front elevational view of the truss member of FIG. 8.

In FIGS. 7–9 the truss member 30 comprises a single D shaped portion. Two such truss members would be assembled back-to-back to the beam members 24, 26, 28, with an overlapping connecting area 54.

As shown in FIGS. 1–5, the truss member 30 includes a second D shaped portion formed as a part of the stamped sheet metal member also formed by a substantially linear portion 34 connected to an arcuate shaped portion 36, the two arcuate shaped portions joined together near their apexes by a connecting portion 54. As shown in FIG. 4, the first D shaped portion lies in a first plane and the second D shaped portion lies in a second plane, and with the connection portion, the two D shaped portions define an acute angle C therebetween.

Figure 11:
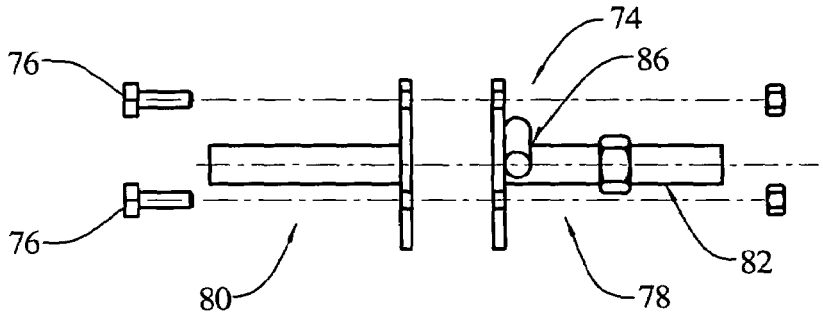
FIG. 11 is a side elevational view of a coupling arrangement for adjacent screed sections.
Figure 12:
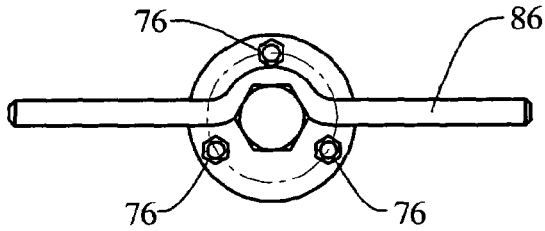
FIG. 12 is a right end elevational view of the coupling arrangement of FIG. 11.
Figure 13:
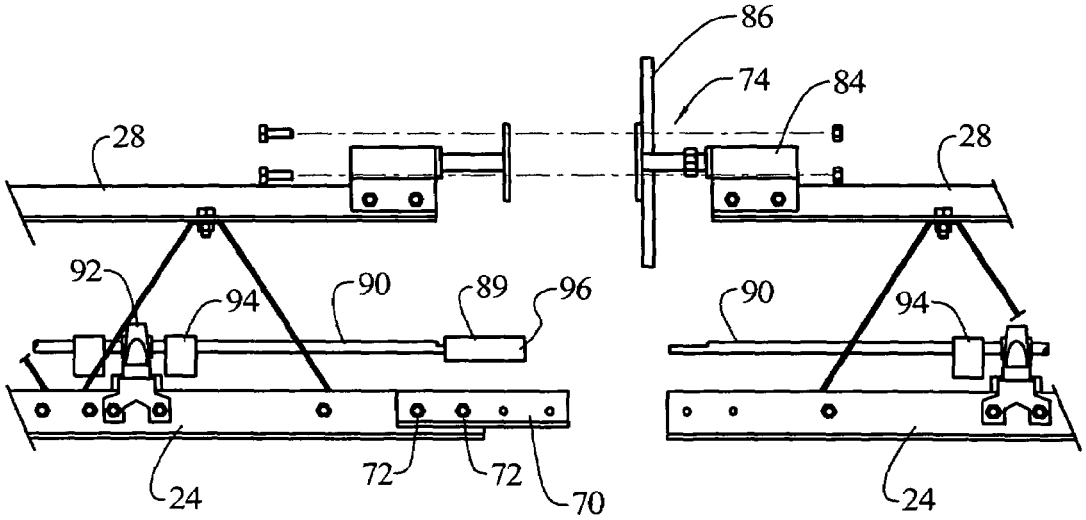
FIG. 13 is a side elevational view of adjacent screed sections being coupled.

Sections of the screed 20 are split at the beam members 24, 26 and 28 as shown in FIG. 13. The lower beam members 24, 26 couple together with an overlapping plate 70 held in place with four fasteners 72 each. The upper beam member 28 couples together with a quick-disconnect "split" turnbuckle 74 shown in FIGS. 11–13. The turnbuckle 74 utilizes three fasteners 76 to quickly come apart into two pieces 78, 80. Screed sections are typically equipped with turnbuckles, in order to finely tune the concave/convex shape of the overall truss section. By splitting the turnbuckle into two halves 78, 80, the time required for aligning and threading is eliminated, thus greatly simplifying the overall assembly. One of the halves 78 includes a threaded shaft 82 which is received in an internally threaded sleeve 84 mounted on the upper beam member 28. The shaft 82 is rotated by means of a handle 86 to move the shaft into or out of the sleeve 84 to adjust the concavity/convexity of the screed section. A locking nut 88 carried on the shaft 82 can be used to wedge against the sleeve 84 to lock the shaft into a desired position relative to the sleeve. The fasteners 72 can be identical to the fasteners 72 used on the lower beam coupler 70.

Low-profile set screws 89 are used to couple a drive shaft 90. The drive shaft is rotated by a motor (not illustrated), is journaled in bearings 92 and carries several eccentric weights 94. Rotation of the drive shaft 90 will impart a vibration to the screed 20 useful in finishing the cement. The set screws 89 are sunk into a coupler 96 for the drive shaft 84 in order to eliminate a protruding profile, such as that presented by a cap screw, since the shaft 90 rotates at more than 3000 rpm.

The present invention provides a truss frame that has a reduced weight as compared to the use of cast truss members, yet has added strength and stiffness in comparison to prior truss frame designs, particularly when utilizing the one piece, parabolic shaped truss members. By use of the special threaded fasteners, the inventive truss frame is easily assembled and the holding strength of these fasteners is more reliable than traditional fasteners, especially in application with continuous vibration. Sections can be coupled together quickly and effectively. The fasteners, used together with the parabolic truss member, compose a structurally sound, reliable and lightweight screed frame.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A cement finishing screed comprising;

a frame member extending a length of said screed, said frame member including a first lower beam member, a second lower beam member, an upper beam member, and a plurality of truss members securing said first and second lower beam members and said upper beam member together in a fixed relationship, each truss member having two arcuate rod portions extending from said first lower beam member and said second lower beam member, respectively, to said upper beam member, and a strut portion extending from a lower end of one of said rod portions to a lower end of another of said rod portions.

2. A cement finishing screed according to claim 1, wherein said two rod portions of each truss member are integrally formed as a single continuous arcuate member attached at a first end to said first lower beam member, attached at a second end to said second lower beam member and attached at a midpoint to said upper beam member.

3. A cement finishing screed according to claim 2, wherein said single continuous arcuate member has a parabolic shape.

4. A cement finishing screed according to claim 2, wherein said strut portion of each truss member is integrally formed with said continuous arcuate member as a single truss member, said strut portion connecting said first end and said second end of said continuous arcuate member.

5. A cement finishing screed according to claim 1, wherein each of said arcuate rod portions attaches to said lower beam portion by means of an extending tab.

6. A cement finishing screed according to claim 5, wherein said tabs each lie in a plane approximately perpendicular to a plane in which its associated arcuate rod portion lies.

7. A cement finishing screed according to claim 5, wherein said tabs comprise an extension of said strut portion and extend outwardly of said arcuate rod member substantially in line with said strut portion.

8. A cement finishing screed according to claim 1, wherein said strut portion has a slight arcuate shape.

9. A cement finishing screed according to claim 1, wherein said truss member is attached to said upper beam and said first and second lower beam members by means of threaded fasteners.

10. A cement finishing screed according to claim 1, wherein said truss members each comprise a stamped sheet metal member having a D shaped portion formed by said strut portion and said two arcuate rod portions forming an arcuate shaped portion, said strut portion being connected at a first and second junction to said arcuate shaped portion, said arcuate shaped portion being attached to said upper beam member near its apex and said arcuate shaped portion being attached to said lower beam members near each junction of said arcuate portion and said strut portion.

11. A cement finishing screed according to claim 10, wherein said stamped sheet metal member further comprises a second D shaped portion including a strut portion connected to an arcuate shaped portion, said two arcuate shaped portions joined together near their apexes by a connecting portion.

12. A cement finishing screed according to claim 11, wherein said first D shaped portion lies in a first plane and said second D shaped portion lies in a second plane, and with said connection portion, said two D shaped portions define an acute angle therebetween.

13. A cement finishing screed according to claim 10, wherein said strut portion has a slight arcuate shape, with a deviation from linear being less than one fifth of a length of said strut portion.

14. A cement finishing screed comprising;

a frame member extending a length of said screed, said frame member including a first lower beam member, a second lower beam member, an upper beam member, and a plurality of truss members securing said first and second lower beam members and said upper beam member together in a fixed relationship, each truss member having four arcuate rod portions, two of said rod portions extending from said first lower beam member at a first end to said upper beam member at a second end and two of said rod portions extending from said second lower beam member at a first end to said upper beam member at a second end, two strut portions, each extending from a first end of one rod portion at one of said lower beam members to a first end of another rod portion at one of said lower beam members.

15. A cement finishing screed according to claim 14, wherein said two rod portions of each truss member are integrally formed as a single continuous arcuate member attached at a first end to said first lower beam member, attached at a second end to said second lower beam member and attached at a midpoint to said upper beam member.

16. A cement finishing screed according to claim 15, wherein said single continuous arcuate member has a parabolic shape.

17. A cement finishing screed according to claim 15, wherein said strut portion of each truss member is integrally formed with said continuous arcuate member as a single truss member, said strut portion connecting said first end and said second end of said continuous arcuate member.

18. A cement finishing screed according to claim 14, wherein said strut portion has a slight arcuate shape.

19. A cement finishing screed according to claim 1, wherein said truss members each comprise a single piece metal stamping, said two arcuate rod portions comprising an arcuate portion having a first end arranged to attach to said first lower beam, a second end arranged to attach to said second lower beam and a mid point arranged to attach to said upper beam, and said single piece stamping further comprises said strut portion which is arranged to extend between said first lower beam member and said second lower beam member.

20. A cement finishing screed according to claim 14, wherein said truss members each comprise a single piece of stamped metal, said four arcuate rod portions further comprise two arcuate portions each having a first end attached to said first lower beam, a second end attached to said second lower beam and a mid point, said mid point of a first of said arcuate portions, integrally joined to the mid point of said second arcuate portion and arranged to attach to said upper beam, said single piece of stamped metal further comprises said two strut portions which are each arranged to extend between said first and second lower beam members.

21. A cement finishing screed according to claim 14, wherein said truss members each comprise;

a single piece metal stamping comprising a first arcuate portion formed of two of said arcuate rod portions and having a first end arranged to extend from said first lower beam and a second end arranged to extend from said second lower beam, a first strut portion extending from said first end to said second end, a second arcuate portion formed from another two of said four arcuate rod portions and having a first end extending from said first lower beam and a second end extending from said second lower beam;

a second strut portion extending from said first end to said second end of said second arcuate portion, and a connecting portion, joining said first and second arcuate portions, midway between said first and second ends.

22. A cement finishing screed according to claim 21, wherein said connecting portion is arranged in a plane parallel to a lower surface of said upper beam member, said first arcuate portion lies in a plane angled downwardly from a first side of said connecting portion at an acute angle relative to said plane of said connecting portion and said second arcuate portion lies in a plane angled downwardly from a second, opposite side of said connecting portion at an acute angle relative to said plane of said connecting portion.

23. A cement finishing screed according to claim 21, wherein said connecting portion includes an area for attaching to said upper beam member.

24. A cement finishing screed according to claim 21, wherein said first arcuate portion and said first strut portion have a first extending tab for attaching to said first lower beam portion and a second extending tab for attaching to said second lower beam portion.

25. A cement finishing screed according to claim 24, wherein said first and second extending tabs each lie in a plane approximately perpendicular to a plane in which said arcuate portion lies.

26. A cement finishing screed according to claim 24, wherein said tabs comprise an extension of said strut member and extend outwardly of said arcuate member substantially in line with said strut member.

27. A cement finishing screed according to claim 21, wherein said strut member has a slight arcuate shape.

28. A cement finishing screed according to claim 21, wherein said arcuate portion has a parabolic shape.

29. A cement finishing screed according to claim 21, wherein said truss member is attached to said upper beam and said first and second lower beam members by means of threaded fasteners.

* * * * *